US009840396B2

(12) United States Patent
Zhu et al.

(10) Patent No.: US 9,840,396 B2
(45) Date of Patent: Dec. 12, 2017

(54) FALL PREVENTION BRAKE BUFFERING SYSTEM FOR HIGH-SPEED MINE LIFT

(71) Applicants: China University of Mining and Technology, Xuzhou (CN); Dongnan Elevator Co. Ltd., Suzhou (CN)

(72) Inventors: Zhencai Zhu, Xuzhou (CN); Guohua Cao, Xuzhou (CN); Jiancong Qin, Xuzhou (CN); Hongqiao Kang, Xuzhou (CN); Guoan Chen, Xuzhou (CN); Weihong Peng, Xuzhou (CN); Wei Li, Xuzhou (CN); Gongbo Zhou, Xuzhou (CN); Renyuan Wu, Xuzhou (CN); Ling Yue, Xuzhou (CN); Yiping Ma, Xuzhou (CN); Jianrong Yang, Xuzhou (CN)

(73) Assignees: China University of Mining and Technology, Xuzhou, Jiangsu (CN); Dongnan Elevator Co. Ltd, Suzhou, Jiangsu (CN)

( * ) Notice: Subject to any disclaimer, the term of this patent is extended or adjusted under 35 U.S.C. 154(b) by 255 days.

(21) Appl. No.: 14/383,836

(22) PCT Filed: Mar. 25, 2013

(86) PCT No.: PCT/CN2013/073108

§ 371 (c)(1),
(2) Date: Sep. 8, 2014

(87) PCT Pub. No.: WO2013/143425

PCT Pub. Date: Oct. 3, 2013

(65) Prior Publication Data

US 2015/0122592 A1 May 7, 2015

(30) Foreign Application Priority Data

Mar. 27, 2012 (CN) ..... 2012 1 0083283

(51) Int. Cl.
*B66B 5/24* (2006.01)
*B66B 7/08* (2006.01)
*B66B 7/10* (2006.01)

(52) U.S. Cl.
CPC ..... *B66B 5/24* (2013.01); *B66B 7/085* (2013.01); *B66B 7/10* (2013.01)

(58) Field of Classification Search
CPC .. B66B 5/185; B66B 5/22; B66B 5/24; B66B 5/28; B66B 7/08; B66B 7/085; B66B 7/10; B66B 15/02; B66B 19/02
See application file for complete search history.

(56) References Cited

U.S. PATENT DOCUMENTS 417,495 A * 12/1889 Moore ..... B66B 5/22 187/372
621,475 A * 3/1899 McCormick ..... B66B 5/20 187/374

(Continued)

FOREIGN PATENT DOCUMENTS

CN 200985231 12/2007
CN 101955102 1/2011

(Continued)

OTHER PUBLICATIONS

International Search Report re PCT/CN2013/073108, dated Jul. 4, 2013, 8 pgs.

*Primary Examiner* — Minh Truong
(74) *Attorney, Agent, or Firm* — Greenberg Traurig, LLP

(57) ABSTRACT

Disclosed is a fall prevention brake buffering system for high-speed mine lift, including brake ropes (2) fixed on two sides of a car (5). One end of the brake rope (2) is fixed on the top part of a vertical well (6), and the other end is fixed on the bottom part of the vertical well (6). A linkage mechanism (11) is arranged at the bottom of the car (5). A buffer (1) is arranged at the top of the brake rope (2), and a (Continued)

tension connector (4) is arranged at the bottom of the brake rope (2). A brake rope safety tong (3) fixed on the brake rope (2) and connected with the linkage mechanism (11) is arranged at the bottom of the car (5). The buffer (1) includes an inverted brake rope gradual safety tong (8) with a buffering rope (9) provided therein and connected with the brake rope (2). A buffering rope clip (10) is arranged on the buffering rope (9). The system is convenient to install, and the buffering force of the brake rope is constant and adjustable. The system realizes reliable fall prevention brake function, greatly improves safety performance during high-speed operation of a lift with non-rigid rails, and increases safety performance during high-speed operation of a mine lift.

2 Claims, 5 Drawing Sheets

(56) References Cited

U.S. PATENT DOCUMENTS 2,518,699 A * 8/1950 Lucas ..... B66B 7/08 403/68
2,518,700 A * 8/1950 Lucas ..... B66B 7/08 403/344
3,119,464 A * 1/1964 Hunter ..... B66B 5/24 187/376
3,441,107 A * 4/1969 Albert ..... B66B 5/04 187/350
5,353,893 A * 10/1994 Sun ..... B66B 7/068 187/412
5,366,045 A * 11/1994 Liston ..... B66B 5/22 187/376
5,964,320 A * 10/1999 Kato ..... B66B 5/22 187/375
6,823,969 B2 * 11/2004 Simmonds ..... B66B 5/22 187/370

FOREIGN PATENT DOCUMENTS

| | | |
|---|---|---|
| CN | 201737551 | 2/2011 |
| CN | 102229395 | 11/2011 |
| CN | 202038786 | 11/2011 |
| CN | 102275799 | 12/2011 |
| CN | 102602772 | 7/2012 |
| CN | 202542624 | 11/2012 |
| GB | 653918 | 5/1951 |
| JP | 51-108324 | 8/1976 |
| JP | 2005239329 | 9/2005 |

* cited by examiner

FALL PREVENTION BRAKE BUFFERING SYSTEM FOR HIGH-SPEED MINE LIFT

TECHNICAL FIELD

The present invention relates to a fall prevention brake buffering system for a high-speed mining elevator, in particular to a fall prevention brake buffering system suitable for a high-speed mining elevator with an elevator car guided by a flexible guide rail, which is also applicable to flexibly guided low-speed elevators and lifting systems.

BACKGROUND

The elevator car protection system widely applied presently is mainly used on elevators that employ a rigid guide rail, because the safety gear of such a safety protection system against over-speed/under-speed of the elevator car of a conventional elevator can take braking effect only on a rigid guide rail; however, when such an elevator car protection system is used on an elevator in an underground works where the geological conditions are complex and the hoistway may deform, the safety gear for fall prevention braking and protection for the elevator car may act unexpectedly; consequently, the elevator car may be stuck in the shaft, which brings a severe potential safety hazard to operation of the elevator. For elevators guided by a non-rigid guide rail, to ensure safe operation of the elevator, patent No. ZL201020286672.0 discloses an elevator car over-speed/under-speed protection system, and patent No. ZL 201120122622.3 discloses a safety gear for braking rope, which can avoid the risk of passenger injury and equipment damage in case the elevator car operates in an over-speed or under-speed state. However, some problems may occur in the fall prevention braking process owing to the high kinetic energy of a high speed elevator, for example, the braking deceleration of the elevator car is too high. Existing over-speed/under-speed protection systems for elevator cars guided by a non-rigid guide rail are only applicable in the field of low-speed elevators. There is no fall prevention brake buffering system for high-speed mining elevators yet up to now. Therefore, it is an urgent task to develop a fall prevention brake buffering system for high-speed mining elevators.

DETAILED DESCRIPTION

Figure 1:
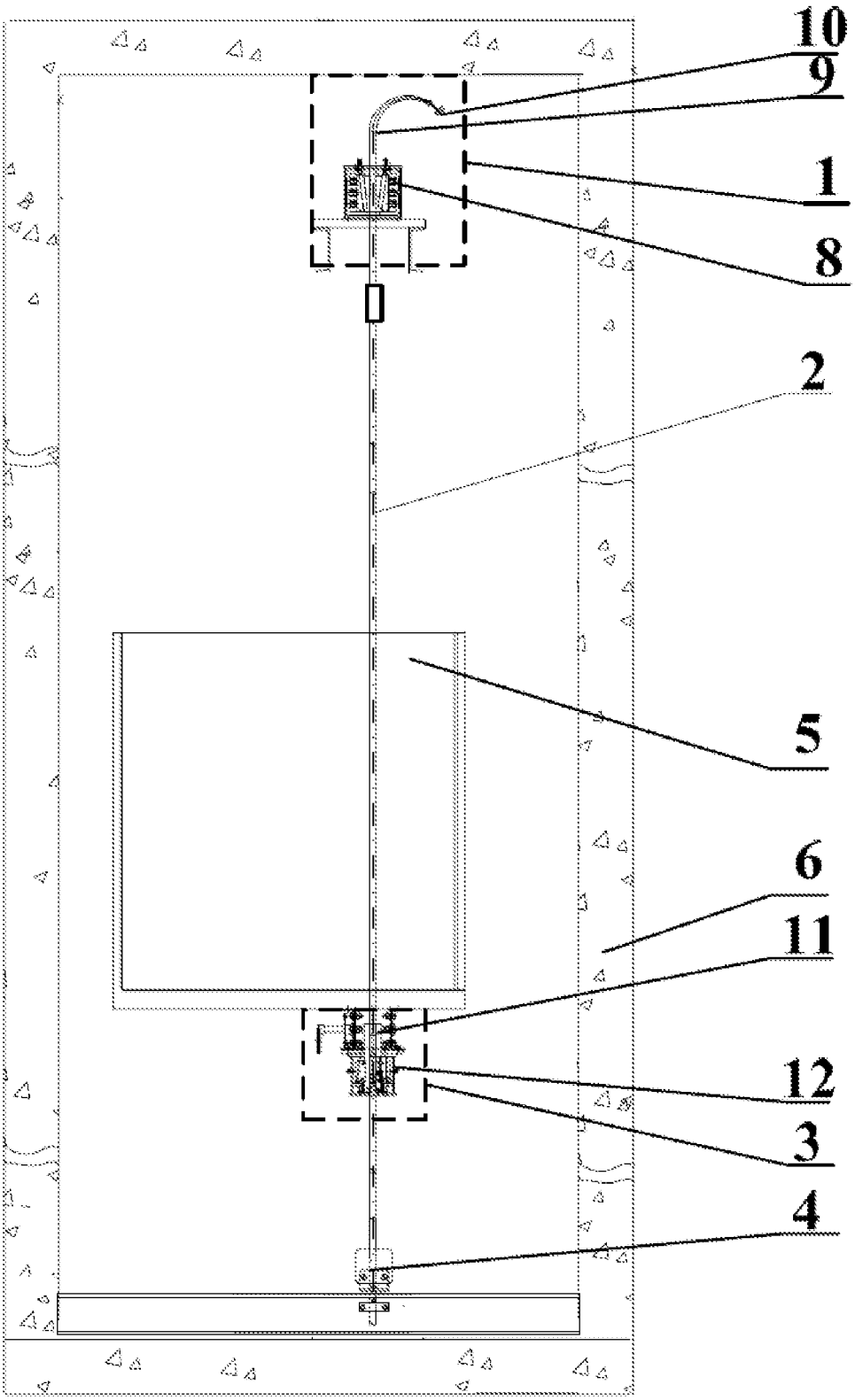
FIG. 1 is a front view of the fall prevention brake buffering system for high-speed mining elevator according to the present invention.

To overcome the drawbacks in the prior art, the present invention provides a fall prevention brake buffering system for high speed elevator, which features with compact structure, excellent buffering effect, reliable braking, and high safety.

The fall prevention brake buffering system for high-speed mining elevator according to the present invention comprises a braking rope fixed to two sides of an elevator car, one end of the braking rope is fixed to the top of a mine shaft, and the other end of the braking rope is fixed to the bottom of the mine shaft, a linkage mechanism is arranged on the bottom of the elevator car, a buffer is arranged on the top of the braking rope, a tension connector is arranged on the bottom of the braking rope, a braking rope safety gear fixed to the braking rope and connected with the linkage mechanism is arranged on the bottom of the elevator car; the buffer comprises an inverted braking rope gradual safety gear, a buffering rope connected with the braking rope is arranged in the braking rope gradual safety gear, and a buffering rope clip is arranged on the buffering rope.

The braking rope gradual safety gear comprises a gear body, a rope groove profile wedge block is arranged in the gear body, the rope groove of the rope groove profile wedge block is arranged with beryllium copper and has a bell mouth on its upper part, a lifting screw rod is arranged on the top of the rope groove profile wedge block.

The braking rope safety gear is an instantaneous braking rope safety gear, the wedge block in the instantaneous braking rope safety gear has a trumpet-shaped rope groove, and the rope groove is arranged with beryllium copper.

The tension connector comprises a wedge-shaped rope clip fastened and fixed on the braking rope by an angle steel part, a wedge block is arranged in the wedge-shaped rope clip, a fixed beam fixed by a connecting bolt is arranged below the angle steel part, and a rope clip designed to fix the terminal of the braking rope is arranged on the fixed beam.

With the technical solution described above, the fall prevention brake buffering system according to the present invention is easy to install, the buffering force of the braking rope is constant and adjustable, the fall prevention braking is reliable, and the safety of high-speed operation of an elevator guided by a non-rigid guide rail can be greatly improved. The present invention can be used as a fall prevention braking and protection system for elevator car to provide a buffering effect on the braking ropes, can achieve reliable braking against falling of the elevator, and thereby improve safety of the high-speed operation of the mining elevator. The major advantages include:

(1) The buffer on the top of the mining elevator braking rope provides a buffering effect during fall prevention braking of the elevator car; thus, the buffering of the elevator car relies on the buffer at the top of the mine shaft rather than the sliding of the elevator car on the guide rail;

(2) A gradual safety gear with a rope groove is used as the buffer for fall prevention braking of the elevator car; thus, the gradual safety gear can be utilized effectively to overcome the difficulty in buffering force setting in the fall prevention braking process of the elevator car;

(3) A tension connector that is set with maximum tension force and simple in structure is used as a tensioner on the bottom of the braking rope; thus, the tension force of the braking rope can be adjusted conveniently, and the drawback that the elevator car grabbed on the braking rope may get loose easily is overcome.

Hereunder an embodiment of the present invention will be further detailed with reference to the accompanying drawings.

Figure 2:
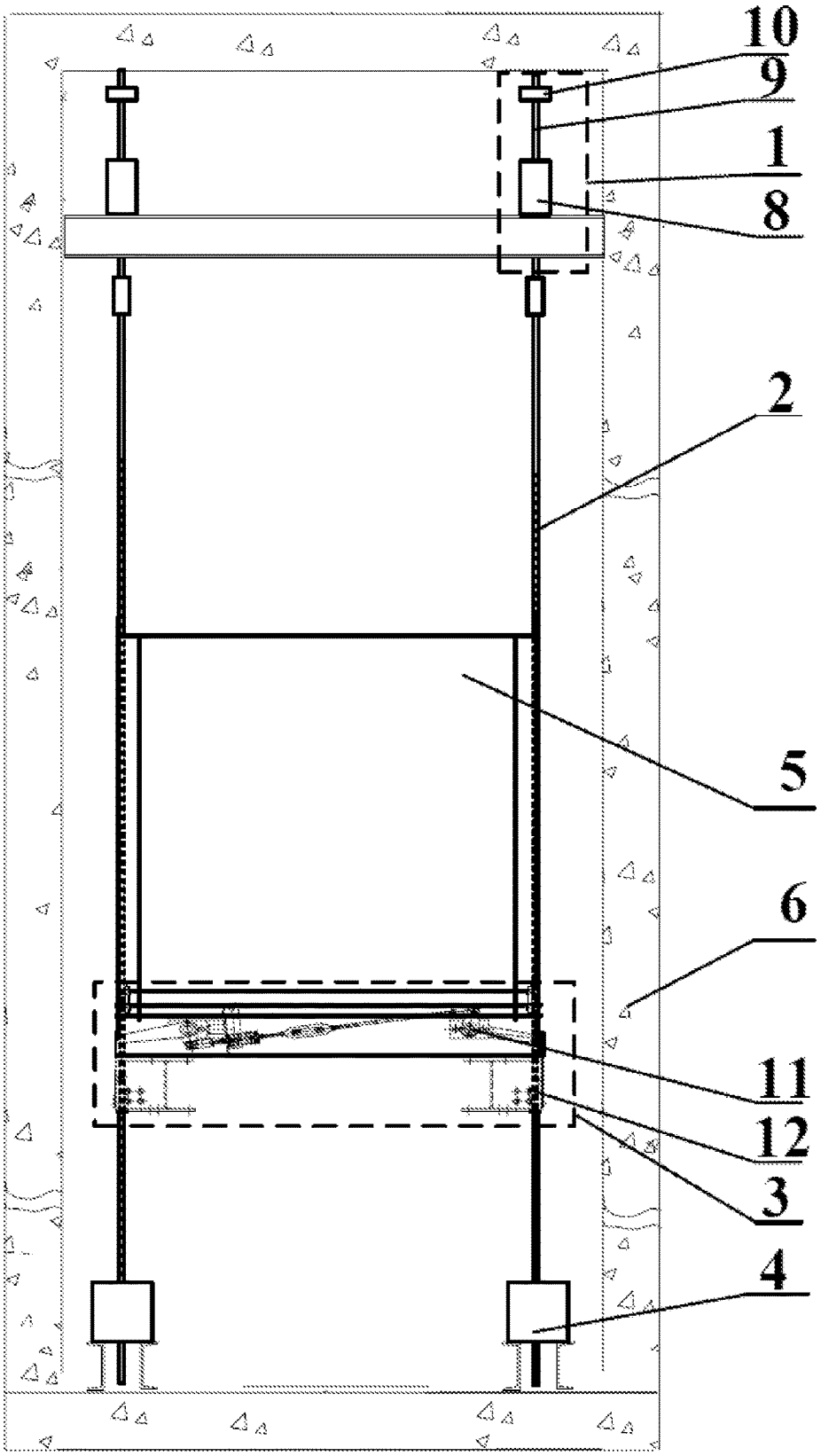
FIG. 2 is a side view of the fall prevention brake buffering system for high-speed mining elevator according to the present invention.

As shown in FIG. 1 and FIG. 2, the fall prevention brake buffering system for high-speed mining elevator according to the present invention mainly comprises a buffer 1, a braking rope 2, a braking rope safety gear 3, a tension connector 4, braking a rope gradual safety gear 8, a buffering rope 9, a buffering rope clip 10, a linkage mechanism 11, and an instantaneous braking rope safety gear 12. The braking rope 2 is fixed to two sides of an elevator car 5, one end of the braking rope 2 is fixed to the top of a mine shaft 6, and the other end of the braking rope 2 is fixed to the bottom of the mine shaft 6, the linkage mechanism 11 is arranged on the bottom of the elevator car 5, the buffer 1 is arranged on the top of the braking rope 2, the tension connector 4 is arranged on the bottom of the braking rope 2, the braking rope safety gear 3 fixed to the braking rope 2 and connected with the linkage mechanism 11 is arranged on the bottom of the elevator car 5, and the braking rope safety gear 3 is an instantaneous braking rope safety gear, the wedge block in the instantaneous braking rope safety gear has a trumpet-shaped rope groove, and the rope groove is arranged with beryllium copper; the buffer 1 comprises the inverted braking rope gradual safety gear 8, the buffering rope 9 connected with the braking rope 2 is arranged in the braking rope gradual safety gear 8, and the buffering rope clip 10 is arranged on the buffering rope 9.

Figure 3:
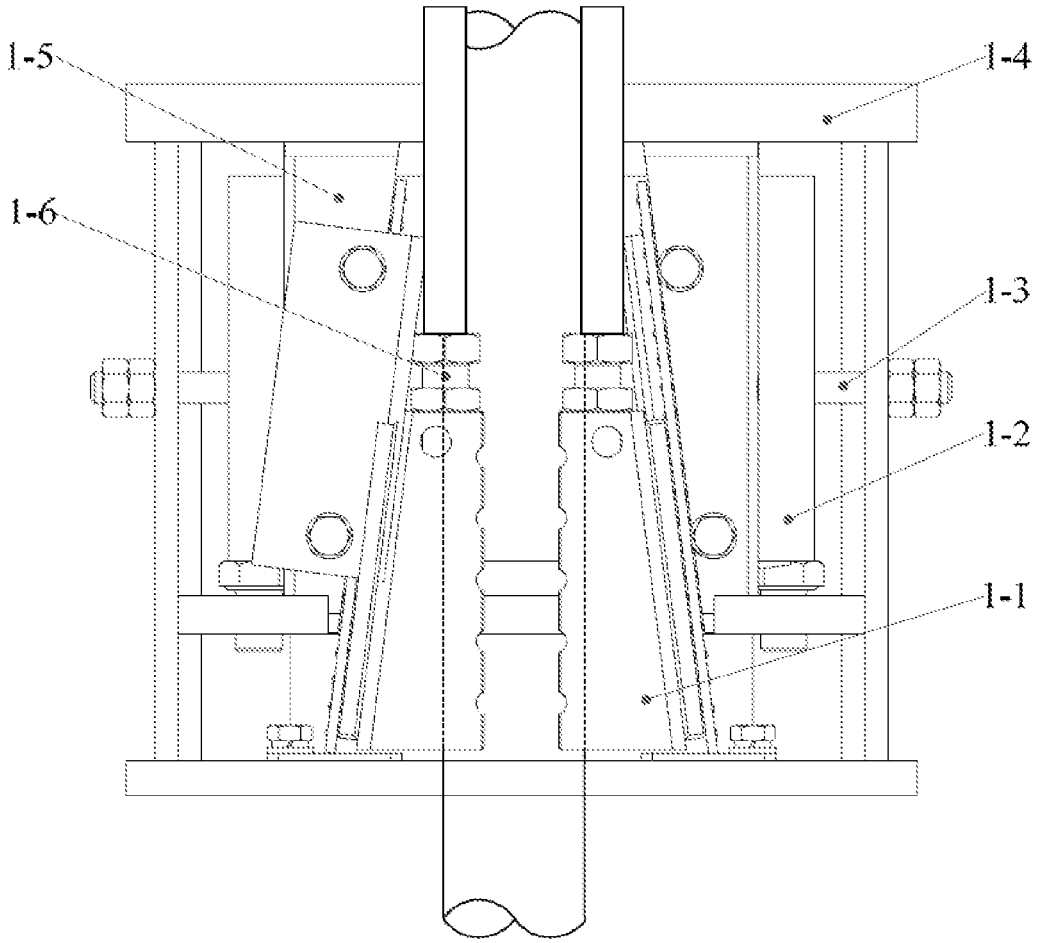
FIG. 3 is a structural diagram of the buffer according to the present invention.
Figure 4:
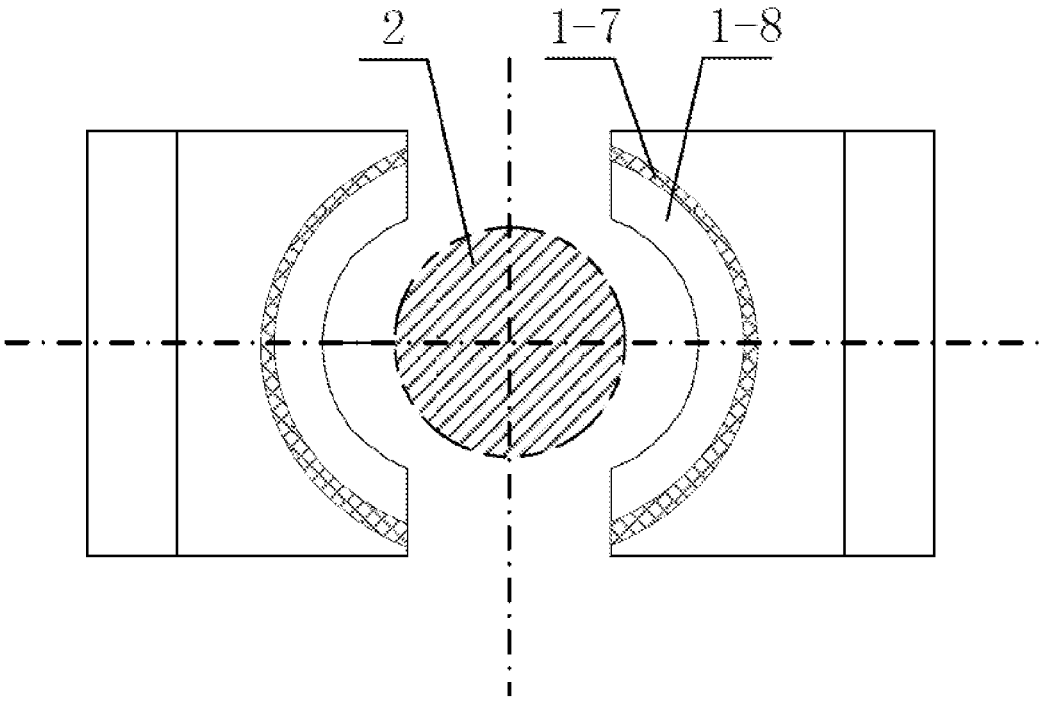
FIG. 4 is a structure diagram of the rope groove of the wedge block in the buffer according to the present invention.

As shown in FIG. 3 and FIG. 4, the braking rope gradual safety gear 8 in the buffer 1 mainly comprises a rope groove profile wedge block 1-1, a U-shaped spring 1-2, a fine adjustment screw rod 1-3, a gear body 1-4, a gear holder 1-5, and a lifting screw rod 1-6; the gear body 1-4 is fitted over the braking rope 2, the rope groove profile wedge block 1-1 and the gear holder 1-5 that are coupled with the rope groove profile wedge block 1-1 are arranged in the gear body 1-4, the rope groove of the rope groove profile wedge block 1-1 is arranged with beryllium copper 1-7 and has a bell mouth 1-8 on its upper part, the U-shaped spring 1-2 and fine adjustment screw rod 1-3 are arranged on two sides of the rope groove profile wedge block 1-1, and the lifting screw rod 1-6 is arranged on the top of the rope groove profile wedge block 1-1.

Figure 5:
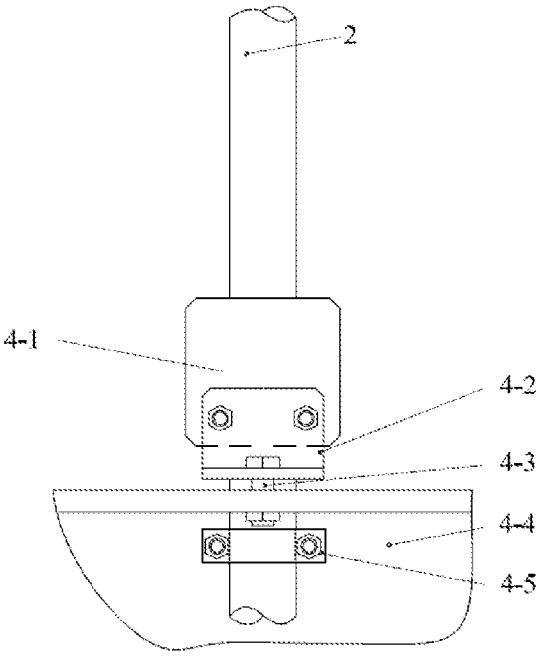
FIG. 5 is a structure diagram of the tension connector in the present invention.
Figure 6:
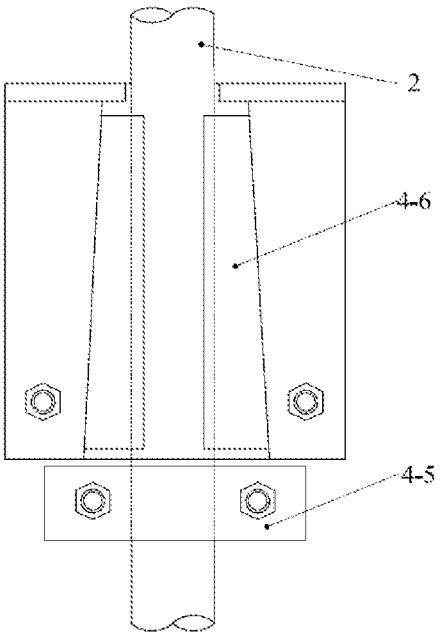
FIG. 6 is a structure diagram of the wedge-shaped rope clip in the tension connector according to the present invention.

As shown in FIG. 5 and FIG. 6, the tension connector 4 comprises a wedge-shaped rope clip 4-1 fastened and fixed on the braking rope 2, an angle steel part 4-2 fixed to the wedge-shaped rope clip 4-1 by bolts, and a connecting bolt 4-3 that is used to connect the angle steel part 4-2 to a fixed beam 4-4 that is made of channel-steel and fixed to the bottom of the shaft; the fixed beam 4-4 fixed by the connecting bolt 4-3 is arranged below the angle steel 4-2, a rope clip 4-5 designed to fix the terminal of the braking rope 2 is arranged on the fixed beam 4-4, and a wedge block 4-6 is arranged in the wedge-shaped rope clip 4-1.

Figure 7:
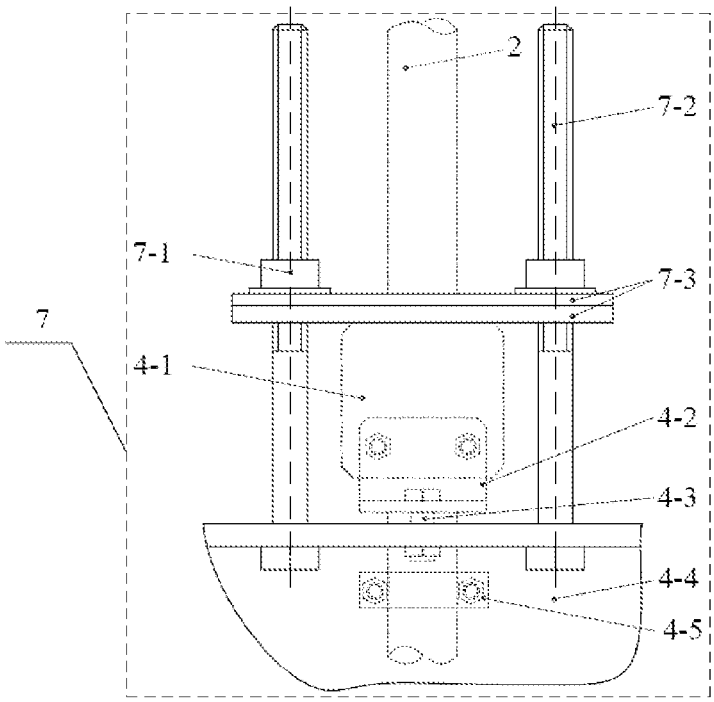
FIG. 7 is a structure diagram of the braking rope tensioner according to the present invention.

FIG. 7 is a structure diagram of the braking rope tensioner. The braking rope 2 can be tensioned up by the braking rope tensioner 7 when desired. The braking rope tensioner 7 comprises adjusting bolts 7-2 that are arranged in symmetry on the two sides of the braking rope 2 and mounted on the fixed beam 4-4, a pressing plate 7-3 is fitted over the adjusting bolts 7-2, and adjusting nuts 7-1 are arranged on the pressing plate 7-3. By tightening up the adjusting nuts 7-1, the pressing plate 7-3 will press the wedge-shaped rope clip 4-1 downwards, and thereby the braking rope 2 is tensioned up. When the tension force reaches a preset value, the connecting bolt 4-3 in the tension connector 4 is tightened up on the fixed beam 4-4, and the adjusting nuts 7-1, adjusting bolts 7-2, and pressing plate 7-3 are removed; in the buffering process during fall prevention braking, the connecting bolt 4-3 has rated breaking strength, and the connecting bolt 4-3 will be broken apart when the elastic wave in the braking rope 2 is transferred to the terminal of the braking rope 2 during fall prevention braking for the elevator car 5, and thereby the elevator car 5 grabs onto the braking rope 2, and will not fall or slide off.

Figure 8:
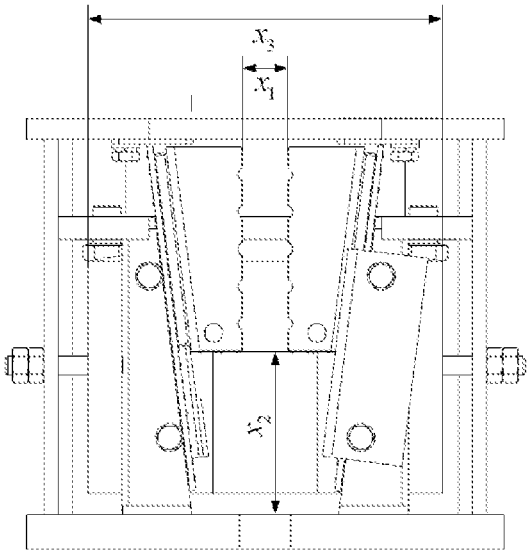
FIG. 8 is a schematic diagram of the buffer according to the present invention before the buffer acts.
Figure 9:
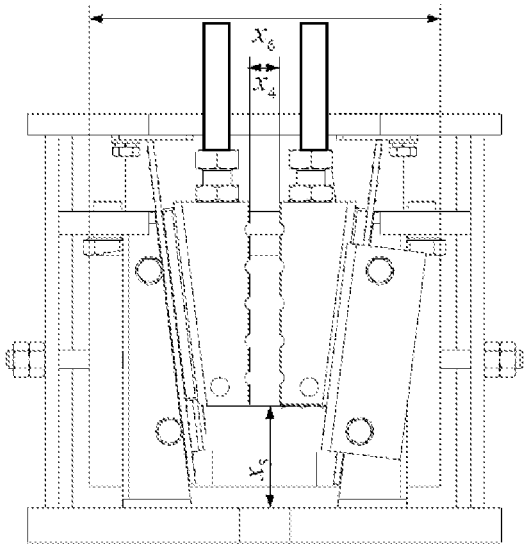
FIG. 9 is a schematic diagram of the buffer in the present invention after the buffer acts.

As shown in FIG. 8 and FIG. 9, the buffer 1 according to the present invention is an inverted braking rope gradual safety gear 8 with a U-shaped spring; the buffering principle and working process of the buffer 1 is as follows:

When the elevator car 5 operates normally, the initial distance between the wedge blocks 1-1 is $x_1$, the distance from the top of the wedge block 1-1 to the bottom surface of the top plate of the gear body 1-4 is $x_2$, and the initial opening distance of the U-shaped spring 1-2 is $x_3$. In case the elevator car 5 operates in an over-speed state, the speed limiter will stop immediately once it detects the running speed of the elevator car 5 exceeds the limit, and the linkage mechanism 11 will drive the instantaneous braking rope safety gear 12 to act, so that the elevator car 5 would be grabbed on the braking rope 2.

As the elevator car moves downwards further, $x_1$ will change to $x_4$ and further decrease, i.e., the wedge block 1-1 and the braking rope 2 will be pressed towards each other, and interaction force will be created between the braking rope 2 and the wedge block 1-1; the U-shaped spring 1-2 suffers the reaction force of the braking rope 2 against the wedge block 1-1 transferred from the wedge block 1-1, and its opening distance increases from the initial value $x_3$ to $x_6$, the distance $x_2$ from the top of the wedge block 1-1 to the bottom surface of the top plate of the gear body 1-4 changes to $x_5$ and decreases gradually, till the wedge block 1-1 is finally pulled down to the lower end and comes into contact with the bottom surface of the gear body 1-4 (i.e., $x_5=0$), where the opening distance $x_6$ of the U-shaped spring 1-2 doesn't increase anymore and the pressing force of the U-shaped spring 1-2 transferred to the wedge block 1-1 on the braking rope 2 keeps constant. In other words, the braking force applied by the braking rope gradual safety gear 8 on the braking rope 2 is in a steady state, and the elevator car 5 is buffered under the braking force in the fall prevention braking process; since the buffering rope 9 has to overcome the friction force continuously when it is pulled out from the braking rope gradual safety gear 8, the kinetic energy of the elevator car 5 of the mining elevator is depleted; when the work done by the buffer 1 is equal to the kinetic energy of the mining elevator at the moment the fall prevention braking happens, the elevator car 5 of the mining elevator will enter into a still state finally; in that way, the elevator car 5 is stopped, and the purpose of effectively protecting the safety of persons, goods, and mining elevator system is attained.

Among the drawings:

1—buffer,
2—braking rope,
3—braking rope safety gear,
4—tension connector,
5—elevator car,
6—mine shaft,
7—braking rope tensioner,
8—braking rope gradual safety gear,
9—buffer rope,

10—buffer rope clip,
11—linkage mechanism,
12—instantaneous braking rope safety gear;
1-1—rope groove profile wedge block,
1-2—U-shaped spring,
1-3—fine adjustment screw rod,
1-4—gear body,
1-5—gear holder,
1-6—lifting screw rod,
1-7—beryllium copper,
1-8—bell mouth;
4-1—wedge-shaped rope clip,
4-2—angle steel part,
4-3—connecting bolt,
4-4—fixed beam,
4-5—rope clip,
4-6—wedge block;
7-1—adjusting nut,
7-2—adjusting bolt,
7-3—pressing plate.

The invention claimed is:

1. A fall prevention brake buffering system for a high-speed mining elevator, comprising:

two braking ropes fixed to two sides of an elevator car, with one end of each of the two braking ropes fixed to an upper part of a mine shaft, respectively and an opposed end of each of the braking ropes fixed to a lower part of the mine shaft, respectively;

a linkage mechanism arranged on a bottom of the elevator car;

a buffer fixed on the upper part of the mine shaft and connected with the end of the braking rope fixed to the upper part of the mine shaft;

a tension connector fixed on the lower part of the mine shaft and connected with the end of the braking rope fixed to the lower part of the mine shaft;

a first braking rope safety gear fixed to the braking rope and connected with the linkage mechanism arranged on the bottom of the elevator car, wherein the buffer comprises an inverted second braking rope safety gear, a buffering rope is connected to the braking rope which is arranged in the second braking rope safety gear, and a buffering rope clip is arranged on the buffering rope, wherein, each of the first and second braking rope safety gears comprises a gear body, a rope groove profile wedge block arranged in the gear body, a rope groove of the rope groove profile wedge block comprising beryllium copper, and an upper part of the rope groove of the rope groove profile wedge block being conical, and a lifting screw rod arranged on the top of the rope groove profile wedge block;

the rope groove profile wedge block of the braking rope safety gear having a conical rope groove;

the tension connector comprises a wedge-shaped rope clip fastened and fixed on the braking rope by:

a steel part which is angled, a wedge block is arranged in the wedge-shaped rope clip, a fixed beam, fixed by a frangible connecting bolt to the steel part, is arranged below the steel part, and a terminal end of the braking rope having a rope clip arranged on the fixed beam; and a braking rope tensioner comprising adjusting bolts arranged in symmetry on two sides of the braking rope, a pressing plate fitted over the adjusting bolts, and at least two adjusting nuts arranged on a pressing plate operable to press the wedge-shaped rope clip downwards to increase tension of the braking rope;

wherein the connecting bolt has rated breaking strength and the connecting bolt will be broken apart when an elastic wave in the braking rope is transferred to the terminal end of the braking rope.

2. The fall prevention brake buffering system for a high-speed mining elevator of claim 1 further comprising a U-shaped spring arranged on two sides of the rope groove profile wedge block biased against a reaction force of the braking rope against the rope groove profile wedge block transferred from the rope groove profile wedge block.

* * * * *